US012653356B2

(12) United States Patent
Wilewski et al.

(10) Patent No.: US 12,653,356 B2
(45) Date of Patent: Jun. 16, 2026

(54) DEVICE TO CLOSE TOILET LID BEFORE FLUSHING

(71) Applicants: Adam Philip Wilewski, Taby (SE); Jessica Maria Penzo, Taby (SE)

(72) Inventors: Adam Philip Wilewski, Taby (SE); Jessica Maria Penzo, Taby (SE)

( * ) Notice: Subject to any disclaimer, the term of this patent is extended or adjusted under 35 U.S.C. 154(b) by 124 days.

(21) Appl. No.: 18/840,958

(22) PCT Filed: Feb. 24, 2023

(86) PCT No.: PCT/SE2023/000004

§ 371 (c)(1),
(2) Date: Aug. 23, 2024

(87) PCT Pub. No.: WO2023/163627

PCT Pub. Date: Aug. 31, 2023

(65) Prior Publication Data

US 2025/0169661 A1 May 29, 2025

(30) Foreign Application Priority Data

Feb. 24, 2022 (SE) ..... 2230055-2

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1–246.5, 248
See application file for complete search history.

(56) References Cited

U.S. PATENT DOCUMENTS

| | | | | |
|---|---|---|---|---|
| 5,058,216 | A * | 10/1991 | Trayer | A47K 13/10 4/246.2 |
| 5,592,700 | A | 1/1997 | Genesse | |
| 6,526,600 | B1 | 3/2003 | Hernandez | |
| 8,671,469 | B1 | 3/2014 | LaMura | |
| 10,149,582 | B1 * | 12/2018 | Eddings | A47K 13/10 |
| 2011/0277228 | A1 | 11/2011 | Corbell et al. | |

OTHER PUBLICATIONS

Search Report and Written for related PCT/SE2023/000004 issued Apr. 18, 2023.

* cited by examiner

*Primary Examiner* — Tuan N Nguyen
(74) *Attorney, Agent, or Firm* — Schott, P.C.

(57) ABSTRACT

Device to close a toilet lid before flushing contains a base part (2) in which a drive device in form of an electrical motor (7) is situated. On top of the base part (2) a motion detector (5) is located that controls a movable arm (3). Within the base part a motherboard (6) is situated. With help from the movement that emerge when flushing the motion detector (5) is activated, that in turn activates the electrical motor (7) that is connected with the movable arm (3) on the front side of the base part (2). The arm (3) opens up 45 degrees, pushes the toilet lid and returns to the origin mode. The detector (4) senses that the lid is no longer resting against the base part (2) and shuts of the device (1). In this way the source of the power consumption, which is a rechargeable battery (3), is limited. The lid is closed completely before flushing and bacteria, virus and the spread of Covid 19 is reduced.

4 Claims, 4 Drawing Sheets

DEVICE TO CLOSE TOILET LID BEFORE FLUSHING

TECHNICAL AREA

This invention designates to a device that can be attached to almost every toilet seat that by movement towards the flushing button via a circuit board activates an electrical motor that automatically closes the toilet lid completely before flushing and in that way limits contamination of different bacteria and Covid19.

TECHNICAL POSITION

There are automatic toilets today that flush themselves and have other technical functions, but these toilets are electrical and expensive. Not even these electrical toilets solve the problem that exists with that the lid should be closed before flushing to prevent the spreading of different diseases, whereby Covid 19 is one of them. There are inventions that with the help of sensors automatically flushes on public toilets. But currently there is no device that can be attached to usual manual toilet seat that drops down the lid and the seating ring completely before flushing, which is the important to stop the spread of infection. In that way the increase of infection is limited that arises from the aerosols that fly up when flushing and that remains in the air, which contain Covid 19 virus and other dangerous bacteria. This has various scientists from different parts of the world agreed upon after performed studies. For instance there has been made a study by Journal of Hospital Infection 2012 and also by scientist in Leeds. This conclusion was also made by the American Institute of Physics after several different advanced studies under 2021. To close the toilet lid on an ordinary non-electric toilet today it is required that you mechanical close the lid with your hand. Many, both adults and children, forget to close the toilet lid before flushing. Some people have a handicap and are not capable to close the lid by themselves and a huge number always leave the lid up, by old ingrained habit. Science shows that harmful bacteria and the feared Covid 19 virus can fly up to a whole 25 cm above the toilet for about 90 min if the lid is not folded down completely when flushing. Our invention helps the user with that problem. It folds the toilet lid completely before flushing with help of a motion detector that is connected with an electrical motor that is found in base of the device. The electrical motor is what drives the device, has a movable arm that is opened in 45 degrees, closes the lid completely before flushing and reduces in that way the dispersion of the before mentioned diseases. After flushing the arm is returned to its original mode and everything can be repeated time and again until the battery needs charging.

Problem Solving

Present invention solves all those displayed problems through that it has in the following claims specified features and is for almost every toilet. It solves the problem with the spread of the accused Covid 19 virus and other bacteria with sequelae.

LIST OF FIGURES

DESCRIPTION

Figure 1:
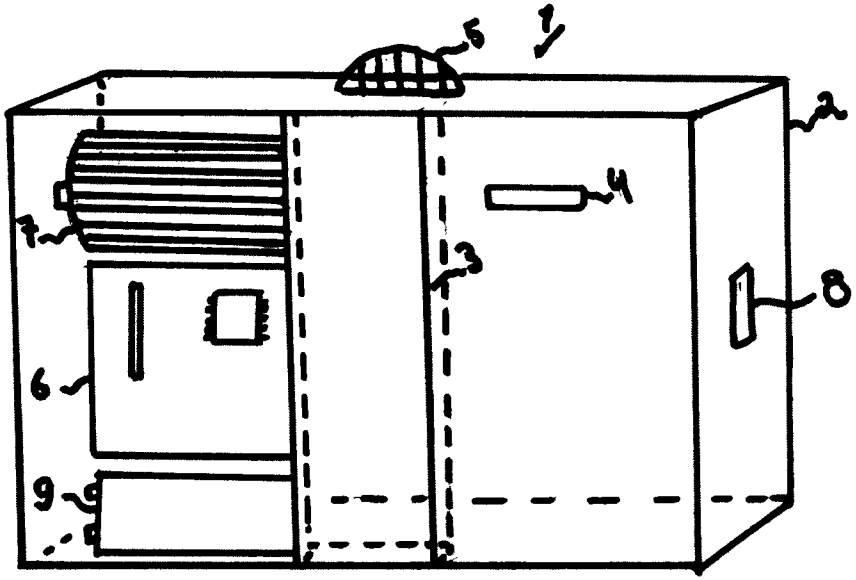
FIG. 1 shows the device from the front.

The invention as mentioned will now be closed described with the help of execution of examples with appurtenant figures. Device for closing the lid before flushing. The in FIG. 1 described device (1) contains a base part (2) that can have any size what so ever and any form what so ever. In the figure the base is quadrangular and about 15×10×2 cm in which a drive device in a form of an electrical motor (7) is situated. On the top of the base part (2) a motion detector (5) that is controlled via control signals that triggers a movable arm (3) that is applied on the base part's front side, see FIG. 1-2. Inside the base part there is a motherboard (6). With the movement that arises when flushing the motion detector (5) is activated that in turn activates the electrical motor (7) that is connected with the movable arm (3) in front of the base part (2). The arm (3) opens up 45 degrees, pushes the toilet lid and returns to origin mode. The sensor (4) senses that the lid no longer rests against the base part (2) and turns the device (1) off. In this way the source of the power consumption, which is a rechargeable battery, is limited.

The working of the device is following: The base part (2) is connected with the help of double adhesive tape (10) on the back of the porcelain part of the toilet tank. The base part (2) is connected about 10 cm below the flushing button on the back part of the toilet tank. The base part (2) has a sensor (4) that is in front of the device (1) and that comes in contact with the toilet lid when open. A control signal is sent from the sensor (4) that is connected to the motherboard (6) that is built in the base part (2) and the device (1) is turned on. At the same time, a signal that activates the motion detector (5) that is placed on top of the base part (2).

When the person is finished and is going to flush, the motion of the hand that is approaching the flush button will trigger the motion detector (5) that is placed on top of the device (1) base part (2) and via a control signal will trigger the built-in mechanical arm (3) that is connected with the electrical motor (7) that can be found built-in the base part (2). The mechanical arm (3) that is carried out 45 degrees, closes without delay the toilet lid and returns to origin mode at once. See FIG. 1-2-3. The device (1) has a drive device in form of an electrical motor (7) that is driven by a rechargeable battery (9) as power source that is built-in the base part (2). In that way no external power source is necessary. Thank you to the sensor (4) that exists, a start signal is sent to turn on and turn off the drive device with help of the location of the toilet lid. Thanks to the sensor (4) that exists and sends a start signal to turn on and turn off the drive device with the help of the toilet lid is up or down so less energy is consumed. Within the base part there is a motherboard (6) that sends out drive signals to the different parts that constitute the device (1). Signals from the motherboard (6) that are connected with the motion detector (5) are given to the mechanical arm (3), see FIG. 2, that opens 45 degrees from the electrical motor (7) and then returns to the origin mode. The electrical motor (7) receives a signal from the motherboard so that the motion detector (5) feels the motion towards the flush button and the arm should close the toilet lid. The base part (1) should be placed almost on the top of the backrest of porcelain of the toilet chair itself behind the toilet lid. See FIG. 3.

Figure 2:
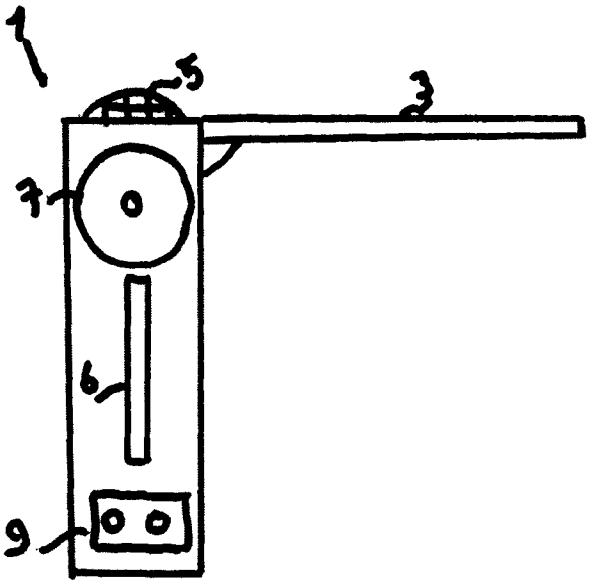
FIG. 2 shows the device from the side.
Figure 3:
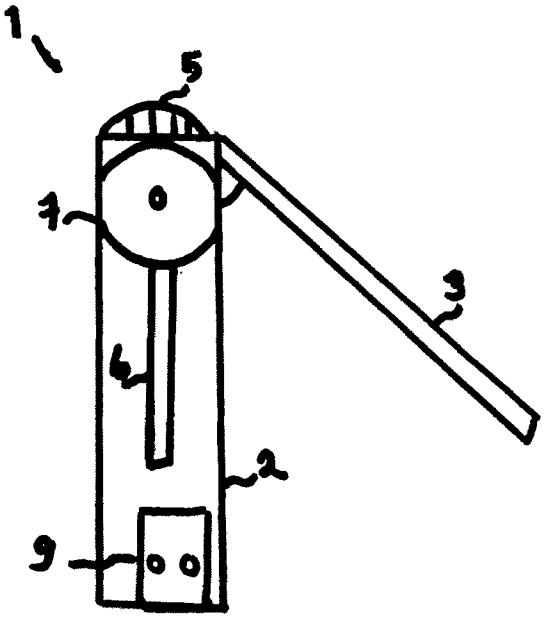
FIG. 3 shows the device from the side with the movable arm in another position.
Figure 4:
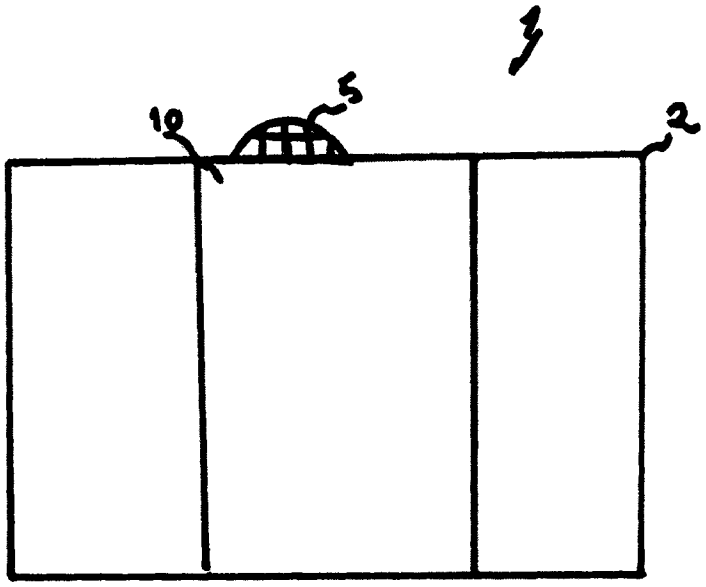
FIG. 4 shows the device from the behind.

When the mechanical arm (3) has pushed the lid, it returns to the normal mode and a control signal is sent to the device to turn off, see FIG. 2. Now the same procedure can be repeated again and again until the battery needs charging. This decreases the spread of dangerous bacteria, virus and Covid 19 that in studies have shown to be spread the different diseases if the toilet lid is not completely shut down when flushing.

The invention claimed is:

1. A device configured to close a toilet lid before flushing and to reduce the spreading of Covid 19 and other bacteria, in which the device comprises:

a detached base part with a motherboard-controlled drive device comprising an electrical motor, and a movable arm proximate to the drive device that is connected to a motion detector via the motherboard, wherein the movable arm is configured to close the toilet lid before flushing with help from movement that occurs at flushing and is detected by the motion detector, wherein the base part is fixed to the toilet tank with double adhesive tape that is placed on the backside of the base part, wherein the front side of the base part has a sensor connected to the motherboard, wherein the base part is configured such that a raised toilet lid will come in touch with the sensor causing the motherboard to send a start signal to the device.

2. The device according to claim 1, wherein the drive device, when launched with help from the motion detector and the electrical motor, performs the closure of the toilet lid before flushing.

3. The device according to claim 2, wherein the device has batteries as a power source.

4. The device according to claim 1, wherein the device has batteries as a power source.

* * * * *